United States Patent [19]

Fernwood

[11] Patent Number: 4,788,778

[45] Date of Patent: Dec. 6, 1988

[54] GEL SLAB DRYER WITH IMPROVED PERIMETER SEAL

[75] Inventor: George G. Fernwood, San Anselmo, Calif.

[73] Assignee: Bio-Rad Laboratories, Inc., Hercules, Calif.

[21] Appl. No.: 68,694

[22] Filed: Jun. 30, 1987

[51] Int. Cl.[4] ..... F26B 13/30

[52] U.S. Cl. ..... 34/92; 34/143; 34/151

[58] Field of Search ..... 34/15, 16, 92, 143, 34/145, 148, 151; 219/524, 533, 520, 459, 345; 38/14, 15, 16; 110/174, 175 R, 179, 180, 182

[56] References Cited

U.S. PATENT DOCUMENTS

| | | | |
|---|---|---|---|
| 683,059 | 9/1901 | McCaslin | 34/16 X |
| 1,536,637 | 5/1925 | Thurnauer | 38/14 |
| 2,251,617 | 8/1941 | Pirnie | 34/15 |
| 2,653,394 | 9/1953 | Nelson et al. | 34/143 |
| 2,661,543 | 12/1953 | Tyndall et al. | 34/16 |
| 3,024,495 | 3/1962 | Thompson | 219/520 |
| 3,135,589 | 6/1964 | Stokes | 34/73 |
| 3,202,278 | 8/1965 | Taylor | 206/80 |
| 3,253,348 | 5/1966 | Oderman et al. | 34/46 |
| 3,253,351 | 5/1966 | Bettanin | 34/92 |
| 3,284,917 | 11/1966 | Foote | 34/21 |
| 3,715,818 | 2/1973 | Sassman | 38/15 |
| 3,889,389 | 6/1975 | Serup | 34/148 |
| 3,935,646 | 2/1976 | Grandine et al. | 34/92 |
| 3,968,581 | 7/1976 | Tsunoda | 38/15 |
| 4,020,563 | 5/1977 | Hoefer | 34/92 X |
| 4,206,345 | 6/1980 | Maass et al. | 219/524 |
| 4,262,189 | 4/1981 | Eisenhoffer | 219/524 |
| 4,274,214 | 6/1981 | Hauser | 38/14 |
| 4,432,956 | 2/1984 | Zarzycki et al. | 423/338 |
| 4,612,710 | 9/1986 | Fernwood | 34/16 |
| 4,664,813 | 5/1987 | Schneider | 34/15 X |

OTHER PUBLICATIONS

H. R. Maurer et al., Polyacrylamide Gel Electrophoresis on Micro Slabs, *Analytical Biochemistry*, 46, 19–32 (Feb. 1972).

R. Lim et al., Autoradiography with Acrylamide Gel Slab Electrophoresis, *Analytical Biochemistry*, 29, 48–57 (Jul. 1969).

D. P. Borris et al., Dried Acrylamide Electrophoresis Gels for Storage or Radioactivity Determination, *Analytical Biochemistry*, 22, 546–549.

K. Wallevik et al., A Simple and Reliable Method for the Drying of Polyacrylamide Slab Gels, *Journal of Biochemical and Biophysical Methods*, 6, 17–21 (Jun. 1982).

S. Joshi et al., Fluorographic Detection of Nucleic Acids Labelled with Weak-Emitters in Gels Containing High Acrylamide Concentrations, *Febs Letters*, vol. 11S, No. 1, (Aug. 1980).

"The Pharmacia Gel Slab Drier GSD-4 with Heater", Pharmacia Fine Chemicals AB.

"Slab Gel Dryers", Hoefer Scientific Instruments.

"Model 1125B High Capacity Gel Slab Dryer", Bio-Rad Laboratories.

"Model 224 Gel Slab Dryer", Bio-Rad Laboratories.

"Power Cooling Drying", LKB.

Atto Corporation Literature-2 Pieces.

*Primary Examiner*—Steven E. Warner

*Attorney, Agent, or Firm*—Townsend and Townsend

[57] ABSTRACT

An apparatus for drying gel slabs which includes a porous support pad resting in a recess, a flexible vacuum-retaining cover sheet covering the support pad and the periphery of the recess, and means for pulling a vacuum down from underneath the support pad, is improved by adding a perimeter groove around the periphery of the recess, preferably spaced a small distance therefrom, with channels connecting the groove to the recess to transmit the vacuum. The perimeter groove provides a faster distribution of the vacuum, and provides a further means of sealing the cover sheet around the periphery of the recess, to provide more even and more reliable gel drying.

13 Claims, 3 Drawing Sheets

GEL SLAB DRYER WITH IMPROVED PERIMETER SEAL

BACKGROUND OF THE INVENTION

This invention relates to laboratory equipment for drying flat gel slabs following their use in electrophoretic separations.

Once the bands occurring in electrophoresis through a gel slab have been formed and spread across the slab, the slab is dehydrated or "fixed" for purposes of preservation and analysis of the electrophoretic pattern. Existing devices for doing this use heat, vacuum or both to dehydrate the gel. One example of such a device is that shown in Fernwood et al., U.S. Pat. No. 4,612,710 (issued Sept. 23, 1986). This and other similar devices rely in part on a vacuum applied to the gel slab from beneath.

An important feature of such a device is that the vacuum be evenly distributed over the entire gel slab, and there be no substantial leaks which would introduce irregularities in the vaporization rate in any region of the slab. As explained in the Fernwood et al. patent, uneven drying raises a risk of causing cracks in the gel as it dries, ultimately distorting the shape of the fixed gel. These devices are particularly susceptible to unreliable vacuum seals which can be both difficult to initiate and prone to continuous leakage due to misalignment of the gel stack components in the recess, and debris at the edge of the recess.

SUMMARY OF THE INVENTION

The present invention seeks to provide a reliable vacuum seal which is easily obtainable when the vacuum is first turned on, and insensitive to minor misalignments of the components in the recess and debris around the perimeter of the recess. This is achieved by the incorporation of a perimeter groove in the dryer base, surrounding the gel slab, with channels communicating the groove with the vacuum source underneath the gel slab. As the vacuum is drawn, the flexible cover sheet which overlies the gel and overlaps the groove is drawn into the groove, which communicates the vacuum quickly around the entire perimeter of the gel. The groove is sufficiently deep and narrow to prevent the cover sheet from filling the groove entirely under the force of the vacuum, thus insuring an uninterrupted flow of air through the groove to distribute the vacuum evenly until equilibrium is reached. The flexible cover sheet then seals at the edges of the groove. The result is an increased rate of vacuum distribution across the entire expanse of the gel slab, as well as a quicker seal against atmospheric air--hence, faster, more even drying.

DETAILED DESCRIPTION OF THE INVENTION AND PREFERRED EMBODIMENTS

Figure 1:
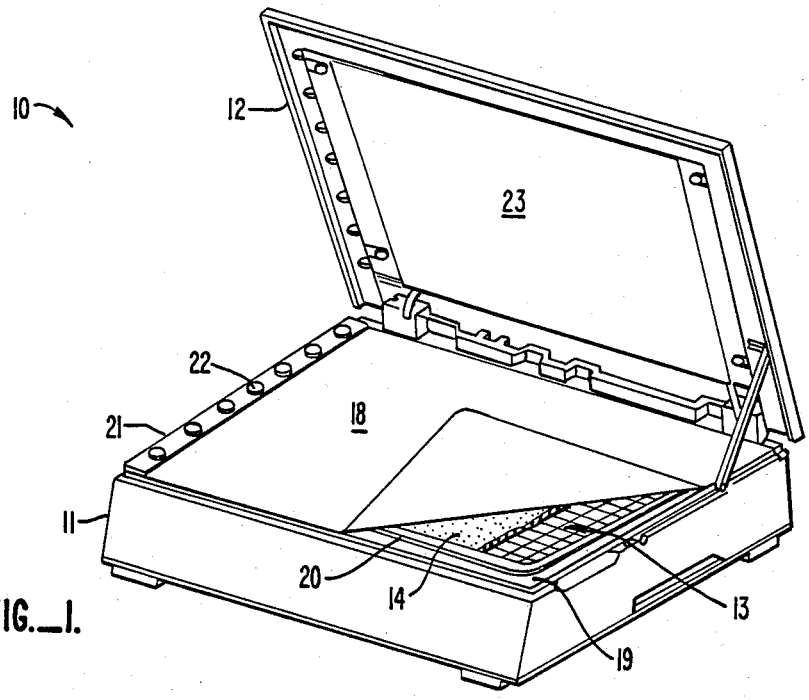
FIG. 1 is a prospective view of an illustrative gel slab drying apparatus according to the present invention, with lid raised, flexible cover sheet folded back, and porous gel support pad partially broken away.

A gel slab dryer 10 representing an illustrative embodiment of the present invention is shown in FIG. 1. The dryer is formed of a base 11 and a lid 12. Both are generally rectangular in shape, the lid being pivotally attached to the base by a hinge connection (not shown) along the rear edge of the base.

A recess 13 is formed in the upper surface of the base 11 for receiving a porous support pad 14 with a flat horizontal upper surface of sufficient length and width to support a wet gel slab. During a typical drying procedure, the gel (not shown in this figure) is interleaved between protective sheets (also not shown) which extend beyond its edges. The pad is generally longer and wider than the gel, leaving a margin encircling the gel of sufficient width to accommodate the excess width of the protective sheets. Although not shown in this figure, a vacuum port passes through the floor of the recess, drawing a vacuum down through the gel slab and the porous support pad 14. The pores in the support pad transmit the vacuum to the gel slab above it, and serve to enhance the vacuum distribution along the gel slab to provide a substantially uniform draw along the entire expanse of the gel slab.

The vacuum is retained by a flexible cover sheet 18 which covers the recess 13 and extends beyond it on all sides to overlap a perimeter ledge 19 which surrounds the recess. Running along the perimeter ledge is a perimeter groove 20, which serves to enhance the vacuum distribution as described above as well as the sealing of the unit. The cover sheet 18 extends over the perimeter groove 20, such that when a vacuum is drawn in the perimeter groove, the cover sheet 18 is drawn down inside it, thereby providing the peripheral seal which is one of the advantages of the present invention. The cover sheet itself is constructed of a material capable of holding a vacuum yet sufficiently deformable to enter the perimeter groove 20 when the pressure inside the groove is reduced.

A wide range of materials may be used to form the cover sheet. A sheet of soft silicone rubber is one example. Although such a sheet may vary in thickness and hardness, a typical thickness is 0.03 inch (0.076 cm), and a typical hardness is that of a 50 Durometer shore hardness A gasket. The cover sheet is secured to the base 11 by a bar 21 along one edge held in place by screws 22. The sheet may be folded back over the bar when access to the recess 13 is needed for insertion or removal of the porous pad and gel slab.

In the embodiment shown, it may also be noted that the lid 12 contains a heating element 23 to enhance the drying rate of the gel slab by applying heat from above, which is transmitted through the cover sheet 18, while vacuum is being drawn from below.

Figure 2:
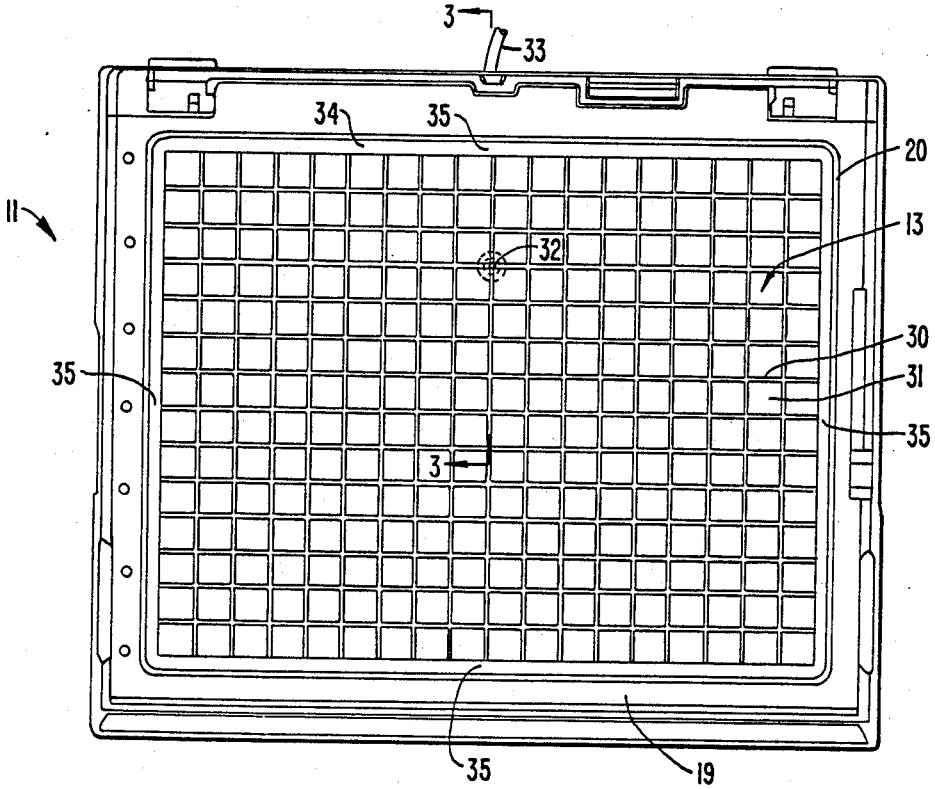
FIG. 2 is a plan view from above of the base portion of the apparatus shown in FIG. 1, with lid, cover sheet, and support pad removed.

FIG. 2 shows the base 11 alone with the porous pad and cover sheet removed. Here it may be noted that the recess 13 contains a network of interconnected grooves 30, spanning the length and width of the recess floor.

The grooves in this embodiment form a rectangular grid, which defines a series of flat plateaus 31. The porous support pad 14 (FIG. 1) rests on these plateaus 31 with the grooves 30 forming open channels underneath. A vacuum port 32 at the base of one of the grooves (or the intersection of two crossing grooves, as shown here) draws a vacuum through the entire groove grid. Vacuum tubing 33 extends from the vacuum port 32 underneath the base to a vacuum source (not shown), generally consisting of a liquid trap succeeded by a vacuum pump.

Surrounding the recess 13 is the perimeter ledge 19, a smooth flat surface which the flexible cover sheet 18 (FIG. 1) overlaps. The perimeter groove 20 is formed in this ledge, and completely surrounds the recess 13. In preferred arrangements, the perimeter groove 20 follows the contour of the edge of the recess 13, and runs parallel to it, both being substantially rectangular. It is also preferred that the perimeter groove 20 be spaced apart from the edge of the recess 13 by a sufficient distance that when the porous pad is thicker than the depth of the recess, the flexible cover sheet has sufficient room to contact the perimeter ledge 19 on both sides of the groove. This provides further assurance that a seal will be formed. The width of the strip 34 of ledge 19 between the groove and the recess edge needed to ensure this contact will vary with the thickness and flexibility of the cover sheet, as well as the height to which the porous pad extends above the perimeter ledge 19 when resting inside the recess 13. In most applications, particularly when a cover sheet having the characteristics of the soft silicon rubber sheet described above is used, a strip of at least about 0.3 cm in width, preferably at least about 0.6 cm will provide the best results. A strip which has been found to be particularly convenient is one which is 0.95 cm (0.375 inch) in width.

The vacuum is supplied to the perimeter groove 20 by the same vacuum source and through the same vacuum port 32 as the vacuum in the recess 13. Communication of the vacuum from the recess 13 to the perimeter groove 20 is achieved by a series of additional grooves 35 traversing the strip 34 between the perimeter groove and the recess edge. While transmission of the vacuum can be achieved by a single such communication groove, two or more are preferred. When the perimeter groove assumes a rectangular configuration as shown in the drawing, the use of four communication grooves 35 is particularly preferred, one joining the perimeter groove 20 at the center of each of its four straight sides.

Figure 3:
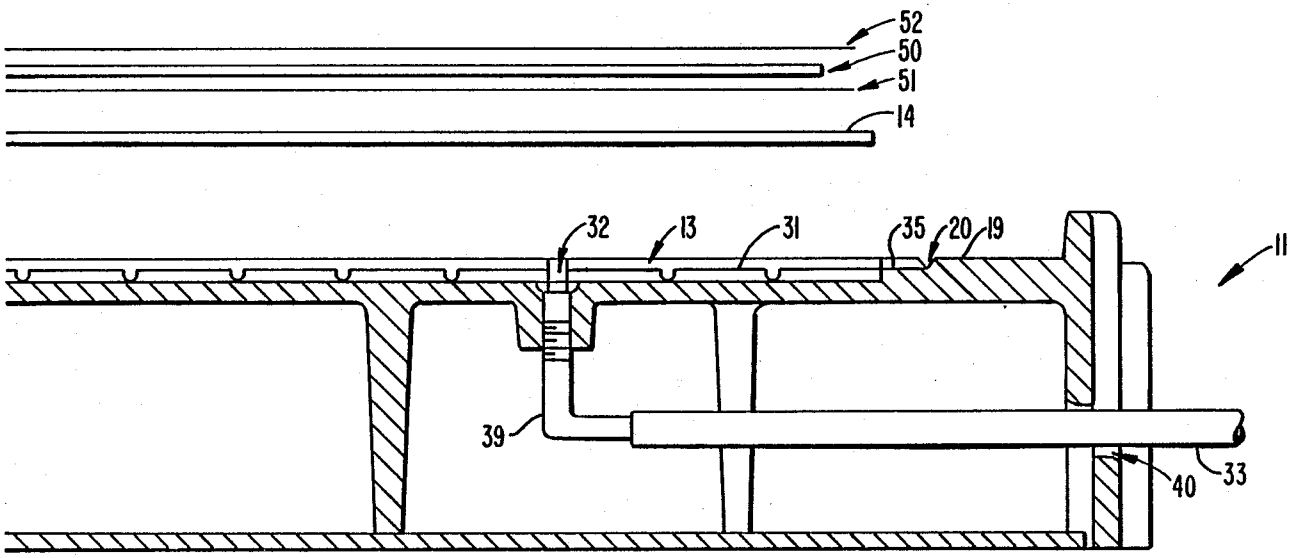
FIG. 3 is a sectional side elevation view of the base shown in FIG. 2, taken along the line 3-3 thereof, also showing the gel slab to be dried therein with upper and lower protective sheets and the support pad, all in exploded form.

Turning now to FIG. 3, the arrangement of the vacuum port 32 and the various grooves is seen in greater detail. In this sectional side view, the vacuum port 32 is joined to the vacuum tubing 33 by a fitting 39 located underneath the recess 13 and inside the base 11 which is hollow. The vacuum tubing 33 passes through a port 40 in the rear wall of the base 11. The plateaus 31 all lie within a plane below the level of the perimeter ledge 19. This plane forms the floor of the recess 13.

It will be noted in this embodiment that the perimeter groove 20 and the communication grooves 35 extend only down to the level of the plateaus 31. The air or vapor flow by which the vacuum is transmitted to the communication and perimeter grooves thus passes through the porous gel support pad 14 resting on top of the plateaus 31.

Figure 4:
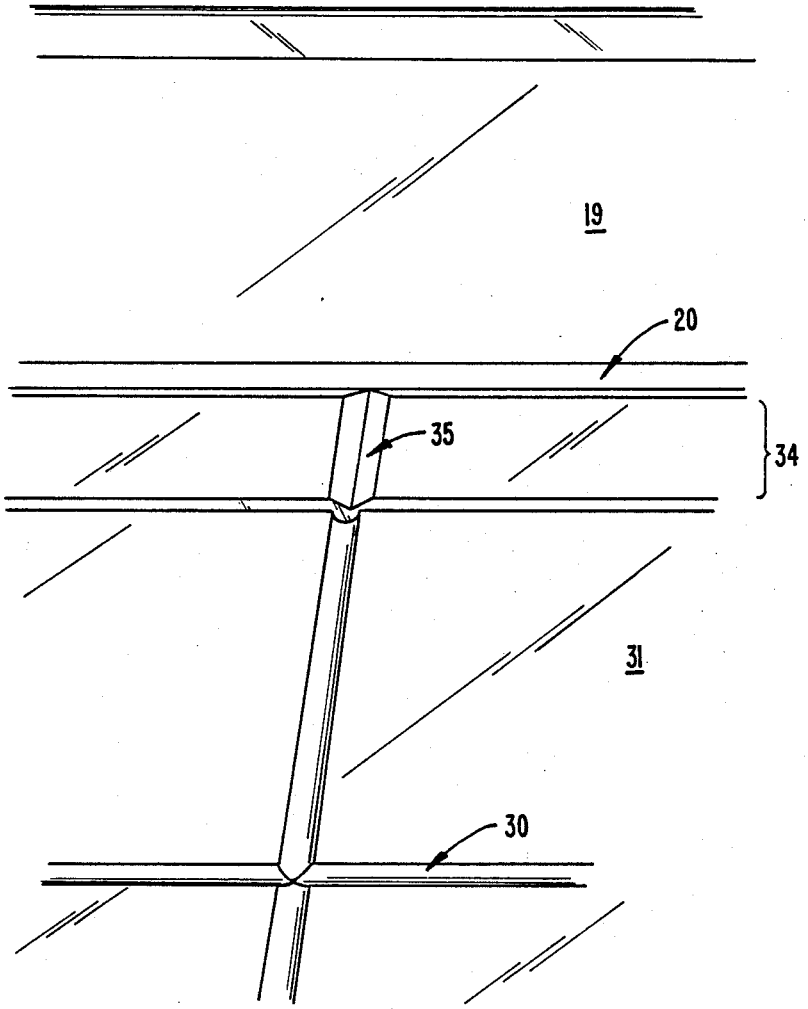
FIG. 4 is an enlarged prospective view of the upper surface of the base shown in FIG. 2.

The groove arrangement is shown in still further detail in FIG. 4. While the grooves 30 forming the network along the floor of the recess are curved or U-shaped, the perimeter groove 20 and the communication grooves 35 have a V-shaped cross section in this embodiment. The shapes or cross sections of these grooves are not critical, and can be varied widely. An important feature of the perimeter and communication grooves, however, is that they be shaped such that when the vacuum is applied and the cover sheet is drawn down into the groove due to the pressure differential, the cover sheet must not fill either the perimeter groove or the communication groove, but instead leave a gap at the base of each.

Figure 5:
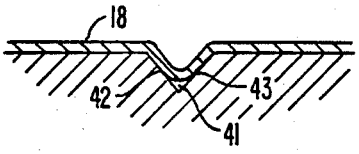
FIG. 5 is an enlarged view in cross section of the perimeter groove shown in FIGS. 1–4 and the flexible cover sheet.

FIG. 5 illustrates this gap 41 in an enlarged profile view. The groove shown in this figure represents either the perimeter groove or any one of the communication grooves. The gap 41 permits air flow to occur underneath the cover sheet 18 even when the cover sheet is distorted as shown by the vacuum. The air flow evens out any pressure differences which might arise, and ensuring a tight seal along the entire length of the perimeter groove at all times.

Smooth surfaces on both the gasket and the walls of the perimeter groove will ensure a high vacuum seal. It is preferred that a Class A smooth finish be used on both.

While this gap 41 may be achieved by using a sharp corner at the point of the V formed by the groove profile as shown in the drawing, it may also be achieved with a round-bottom groove, provided that the side walls 42, 43 of the groove are steep enough and close enough together that the flexible cover sheet 18 is unable to penetrate to the bottom of the groove.

The use of a perimeter groove in accordance with this invention permits one to use a flow rate as low as 10 liters per minute in establishing a vacuum to a pressure as low as 350 torr (16 inches mercury of vacuum). When making the initial seal, the user may apply mechanical means for holding the cover sheet over the groove. The seal will actually be made at the upper edge of the groove first.

Returning now to FIG. 3, the system is intended for use with a gel slab 50 bounded by protective layers 51 below and 52 above as commonly used in drying and fixing gel slabs. The materials for the protective layers may be those commonly used in the prior art. The lower protective layer is a sheet sufficiently porous to permit vapor flow therethrough, and sufficiently sorptive to bond to the gel as the gel dries. Common laboratory filter paper of various grades or cellophane are generally used. The upper protective sheet 52 may be porous or nonporous, but in any event readily deformable. When the vacuum is applied, the upper sheet will tightly cling to the edges of the gel. When the sheet is fabricated of a porous material such as cellophane, the gel will adhere to it upon drying. The sheet must therefore be clear to permit visual analysis once the drying is completed. Examples of clear nonporous materials are Saran Wrap TM, Glad Wrap TM, and Mylar TM. Nonadherent porous materials such as porous polyethylene or porous polypropylene are removable from the dried gel and thus need not be clear. In general, however, clear materials are preferred for both the upper protective sheet 51 and the cover sheet 18 of the drying apparatus so that the progress of the drying can be visually monitored without disrupting the vacuum. In some instances, the upper protective sheet may be eliminated entirely and the cover sheet 18 may serve as the sole protection for the upper surface of the gel slab.

The system of the present invention provides a number of advantages to similar preexisting designs. With the use of the perimeter groove, the flow rate of the vacuum pump is less critical, and lower flow rates are acceptable. Second, the porous support pad 14 need no longer be a close fit inside the recess 13 for purposes of obtaining a proper seal and even vacuum distribution. Gaps along the sides of the support pad are more readily tolerated.

Still further, the height of the support pad is also less critical, so long as the strip of the perimeter ledge 19 between the perimeter groove 20 and the edge of the recess 13 is wide enough to permit contact with the cover sheet 18. The alignment of the slab gel and its protective layers is also less critical.

The foregoing description is offered primarily for illustrative purposes. It will be readily apparent to those skilled in the art that numerous modifications and variations of the materials, construction, and techniques disclosed above may be introduced without departing from the spirit and scope of the invention, as defined by the appended claims.

What is claimed is:

1. In an apparatus for drying a gel slab, said apparatus including a base having an upper surface with a recess therein having a floor with a vacuum port passing therethrough, a ledge surrounding said recess, a porous pad sized to fit inside said recess and to support said gel slab, and a deformable vacuum-retaining cover sheet of sufficient size to cover said recess and extend over said ledge, the improvement comprising:

a groove in said ledge encircling said recess; and means for communicating said groove with said recess;

said groove being fully enclosed along bottom and sides except for said communicating means.

2. An apparatus in accordance with claim 1 in which said recess and said ledge meet at a perimeter edge, and said groove runs substantially parallel to said perimeter edge.

3. An apparatus in accordance with claim 1 in which said groove is spaced apart from said recess by at least about 0.3 cm.

4. An apparatus in accordance with claim 1 in which said groove is spaced apart from said recess by at least about 0.6 cm.

5. An apparatus in accordance with claim 1 in which said groove has a substantially V-shaped cross section.

6. An apparatus in accordance with claim 1 in which said perimeter groove is sufficiently sharp cornered that said deformable vacuum-retaining cover sheet when drawn into said perimeter groove by a vacuum of approximately 250 torr leaves a gap at the bottom thereof.

7. An apparatus in accordance with claim 1 in which said groove is defined as a perimeter groove, and said communicating means is comprised of at least one communicating groove in said ledge joining said perimeter groove with said recess.

8. An apparatus in accordance with claim 7 in which said perimeter groove and said communicating groove have substantially V-shaped cross sections.

9. An apparatus in accordance with claim 7 in which said perimeter groove and said communicating groove are sufficiently sharp-cornered that said deformable vacuum-retaining cover sheet when drawn into said perimeter groove and said communicating groove by a vacuum of approximately 250 torr absolute leaves a gap at the bottom thereof.

10. An apparatus in accordance with claim 7 in which said recess is substantially rectangular in shape, and said perimeter groove is substantially rectangular in shape with sides substantially parallel to those of said recess and substantially equidistant therefrom on all four sides.

11. An apparatus in accordance with claim 10 in which said communicating means is comprised of one said communicating groove joining each of at least two sides of said perimeter groove with said recess.

12. An apparatus in accordance with claim 10 in which said communicating means is comprised of one said communicating groove joining each of all four sides of said perimeter groove with said recess.

13. In an apparatus for drying a gel slab, said apparatus including a base having an upper surface with a recess therein having a floor with a vacuum port passing therethrough, a ledge surrounding said recess, a porous pad sized to fit inside said recess and to support said gel slab, and a deformable, vacuum-retaining sheet of sufficient size to cover said recess and extend over said ledge, the improvement comprising:

a perimeter groove of substantially V-shaped cross section in said ledge encircling said recess and spaced apart therefrom at all points by a distance of at least about 0.6 cm; and a plurality of communicating grooves of substantially V-shaped cross section in said ledge joining said perimeter groove with said recess;

said perimeter groove and said communicating grooves being sufficiently sharp-cornered that said deformable vacuum-retaining cover sheet when drawn into said perimeter groove and said communicating grooves by a vacuum of approximately 250 torr leaves a gap at the bottom thereof.

* * * * *